United States Patent [19]

McElroy

[11] 3,936,622

[45] Feb. 3, 1976

[54] LOAD LIMITER

[75] Inventor: Robert C. McElroy, Libson, Ohio

[73] Assignee: Cable Climber Safety Devices Incorporated, Lisbon, Ohio

[22] Filed: Apr. 4, 1974

[21] Appl. No.: 457,967

[52] U.S. Cl. ..... 200/85 R; 212/39 DB; 254/173 R

[51] Int. Cl.[2] ..... H01H 3/14

[58] Field of Search.. 208/85 R; 212/39 DB, 39 MS; 254/173 R, 174 R

[56] References Cited

UNITED STATES PATENTS

| | | | |
|---|---|---|---|
| 2,629,851 | 2/1953 | Gilbert | 200/85 R |
| 2,636,953 | 4/1953 | Hunt | 200/85 R |
| 3,728,502 | 4/1973 | Hawkins et al. | 200/85 R |

FOREIGN PATENTS OR APPLICATIONS

| | | | |
|---|---|---|---|
| 814,642 | 6/1959 | United Kingdom | 212/39 DB |

*Primary Examiner*—David Smith, Jr.
*Attorney, Agent, or Firm*—Blair & Brown

[57] ABSTRACT

A load limiter is provided for a lift hoist wherein the upper portion is fastened to the lift hoist and the lower portion is fastened to a load. A micro-switch is mounted on the upper half and actuated by movement of the lower half and is provided with an adjustment screw that can be adjusted to vary the load which will break a circuit of the lift hoist. The micro-switch is used in series with an operating switch to shut off the hoist motor when the load limit is reached to prevent damage to equipment or injury to personnel.

1 Claim, 5 Drawing Figures

FIG. 1.
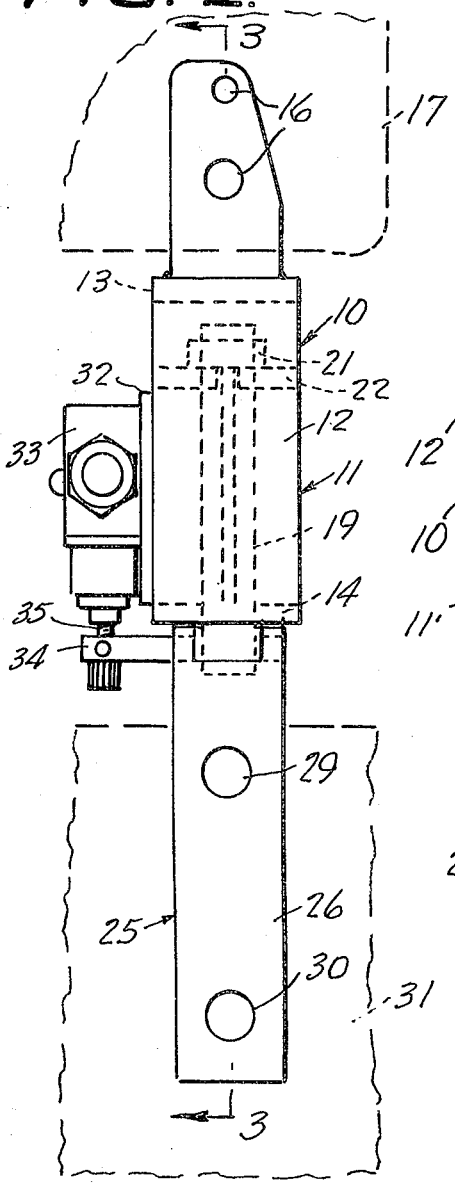
FIG. 2.
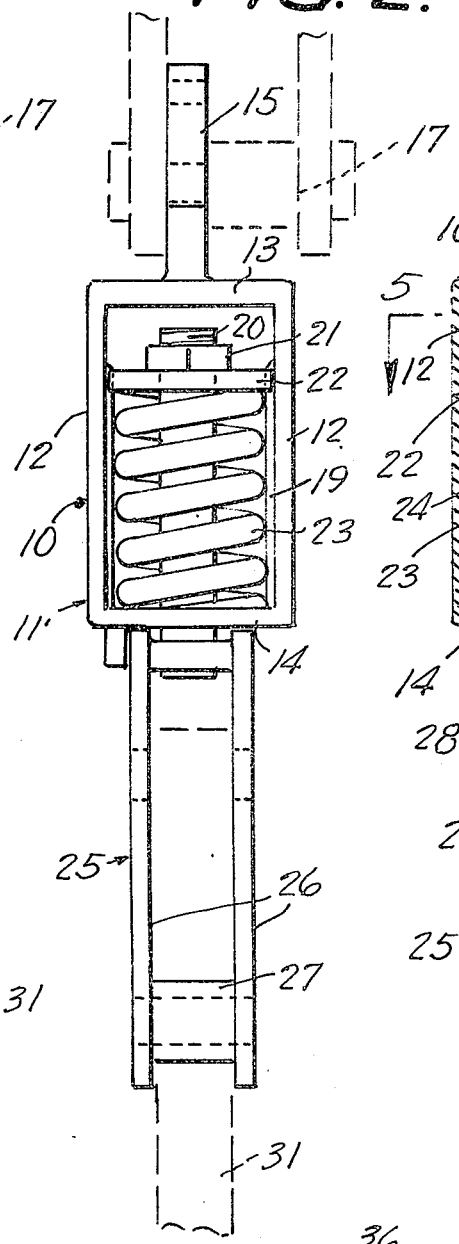
FIG. 3.
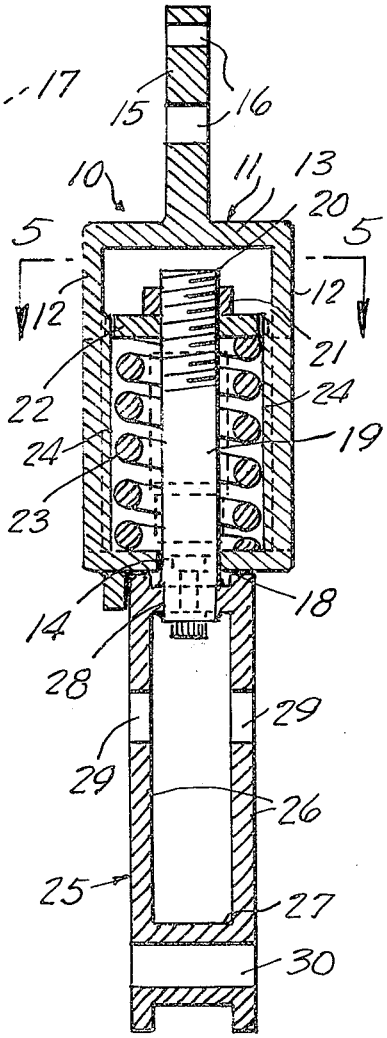
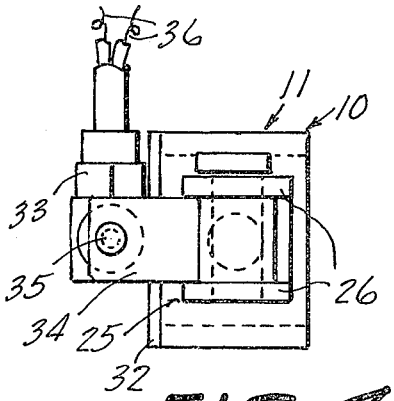
FIG. 4.
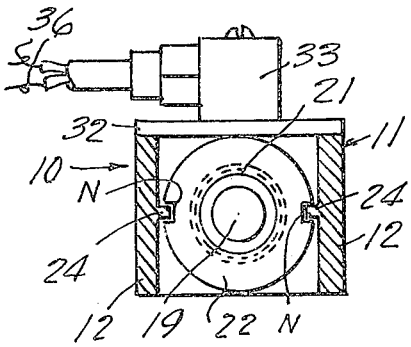
FIG. 5.

LOAD LIMITER

BACKGROUND OF THE INVENTION

Field of the Invention

The present invention relates to lift hoists, and more particularly to load limiters for lift hoists.

SUMMARY OF THE INVENTION

A load limiter is provided for a lift hoist wherein when the load limit is reached through overload or hangups of scaffolding or the like, the motor of the hoist will be shut off to prevent any damage to the hoist, cable, supports as well as preventing possible injury to personnel through accidents that may be caused by overloading.

The primary object of the invention is to provide a load limiter for preventing the use of a lift hoist by interrupting a circuit to shut off the motor of the hoist when the load limit is reached.

Still another object of the present invention is to provide a load limiter that is rugged in construction and fool proof in use and which is simple and inexpensive to manufacture.

Other objects and advantages will become apparent in the following specification when considered in light of the attached drawings.

BRIEF DESCRIPTION OF THE DRAWINGS

FIG. 1 is an elevational view of the load limiter of the present invention;

FIG. 2 is a view taken at right angles to the view shown in FIG. 1;

FIG. 3 is a sectional view, taken on the line 3—3 of FIG. 1;

FIG. 4 is an end elevational view of the load limiter; and

FIG. 5 is a sectional view, taken on the line 5—5 of FIG. 3.

DESCRIPTION OF THE PREFERRED EMBODIMENT

Referring now to the drawings in detail, wherein like reference characters indicate like parts throughout the several figures, the reference numeral 10 indicates generally, the load limiter of the present invention which includes a support member 11 having spaced parallel vertically disposed side walls 12 as well as a top wall 13 and a bottom wall 14, FIG. 2. An upper element 15 is secured to the top of the support member 11 and has openings 16 therein whereby the device can be suitably connected to a lift hoist, a portion of which is indicated by the numeral 17.

The bottom wall 14 has an opening 18 therein and a vertically disposed moveable rod 19 extends therethrough. The upper end of the rod 19 is threaded at 20 to receive a nut 21 that secures a plate 22 on the rod 19. A coil spring 23 surrounds the rod 19, and the coil spring 23 is positioned below the plate 22. Stop guides 24 are secured to the opposed faces of the side walls 12 and notches N in the plate 22 thereover to prevent the spring 23 from being deflected on overload to a point that would change the K factor.

A bracket 25 is mounted below the support member 11 and includes spaced parallel side sections 26 as well as a bottom portion 27 and a top piece 28. Openings 29 and 30 in the bracket 25 are provided for fastening the bracket 25 to a load 31, FIG. 1.

A horizontally disposed lug 34 is connected to the bracket 25. A vertically disposed support plate 32 is connected to the support member 11 and has a micro-switch 33 mounted thereon. An adjustment screw 35 depends from the lower end of the micro-switch 33 whereby the actuation of the micro-switch 33 can be adjusted as desired. Electrical conductor wires 36 electrically connect the micro-switch 33 in series with an operating switch (not shown).

From the foregoing, it will be seen that there has been provided a load limiter, and in use with the parts arranged as shown in the drawings, the member such as the member 15 is connected to the lift hoist 17 as at 16. The bracket 25 is connected to the load 31 by means of securing elements (not shown) that extend through the openings 29 and 30. The micro-switch 33 is electrically connected to the operating switch by means of the wires 36. Thus, during normal usage of the apparatus, the load compresses the spring 23 slightly whereby the rod 19 moves downwardly in response to normal load conditions. In the event of an overlaod the spring 23 is compressed further so that the micro-switch 33 is actuated to shut off the motor of the hoist whereby damage to the parts or injury to the personnel will be prevented. The manually operative adjustment screw 35 can be adjusted to change the setting of the micro-switch 33 so that the load limiter will cut off the motor at any desired load level.

The upper element 15 is fastened to the lift hoist and the bracket 25 of the load limiter is fastened to the load. Also, the bracket 25 of the load limiter is fastened to a rod 19 that extends up through the spring 23 and fastens to a plate 22 and nut 21 to impose a load on the spring 23 when weight is put on the bracket 25 of the load limiter of the present invention.

A micro-switch 33 is fastened to the upper member 15 of the load limiter, and an adjustment screw 35 is connected to a lug 34 on the upper member 15 of the load limiter. The adjustment screw 35 is set against the actuating button of the micro-switch 33 and is adjusted so that it will break the circuit on the micro-switch 33 at a pre-selected loading such as 500 to 1500 pounds suiting the load to the application with which the device is used. The micro-switch 33 is used in series with an operating switch (not shown), so that when the load limit is reached through overload or hangups of scaffolding or the like, the motor of the hoist is shut off. This will prevent any damage to the hoist, cable, supports as well as preventing injury to personnel through accidents that may be caused by overloading.

Having thus described the preferred embodiment of the invention it should be understood that numerous structural modifications and adaptations may be resorted to without departing from the spirit of the invention.

What is claimed is:

1. A load limiter comprising a support member including spaced parallel vertically disposed side walls, spaced parallel, horizontally disposed top and bottom walls, an upper element affixed to said top wall for connection to a hoist, there being an opening in said bottom wall, a vertically disposed moveable rod extending through said opening and said rod having it's upper end threaded, a horizontally disposed vertically moveable plate mounted on the upper portion of said rod, stop guides on said side walls cooperating with said plate for preventing the spring from being deflected out of its proper position on over loads, means mounted above said plate adjustably engaging the upper end of said rod, a coil spring surrounding said rod and interposed between said plate and said bottom wall, a bracket mounted below said support member and said bracket including a pair of spaced parallel side sections and a bottom portion, means for connecting said bracket to a load, a top piece extending between said side sections and having the lower end of said rod extending therethrough, a vertically disposed support piece affixed to said support member, a micro-switch connected to said support piece, and an adjustment screw connected to the lower end of said micro-switch and to a lug on said upper element.

* * * * *